US009840981B2

(12) United States Patent
Brandt et al.

(10) Patent No.: US 9,840,981 B2
(45) Date of Patent: Dec. 12, 2017

(54) METHOD FOR ADAPTING THE INJECTION CHARACTERISTIC OF AN INJECTION VALVE

(75) Inventors: Martin Brandt, Worth a.d. Donau (DE); Janos Radeczky, Wenzenbach (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 488 days.

(21) Appl. No.: 13/819,017

(22) PCT Filed: Aug. 16, 2011

(86) PCT No.: PCT/EP2011/064073
§ 371 (c)(1),
(2), (4) Date: Feb. 26, 2013

(87) PCT Pub. No.: WO2012/025428
PCT Pub. Date: Mar. 1, 2012

(65) Prior Publication Data

US 2013/0152902 A1 Jun. 20, 2013

(30) Foreign Application Priority Data

Aug. 26, 2010 (DE) ..... 10 2010 039 841

(51) Int. Cl.
*F02D 41/40* (2006.01)
*F02D 41/24* (2006.01)
(Continued)

(52) U.S. Cl.
CPC ..... *F02D 41/40* (2013.01); *F02D 41/2432* (2013.01); *F02D 41/2467* (2013.01);
(Continued)

(58) Field of Classification Search
CPC ..... F02D 2200/0614; F02D 2200/063; F02D 41/2432; F02D 41/2435; F02D 41/2441;
(Continued)

(56) References Cited

U.S. PATENT DOCUMENTS 6,847,881 B2 * 1/2005 Melbert ..... F02D 41/2096 123/446
6,988,490 B2 1/2006 Satou ..... 123/480
(Continued)

FOREIGN PATENT DOCUMENTS

CN 1648429 A 8/2005 ..... F02B 17/00
CN 101395361 A 3/2009 ..... F02D 41/12
(Continued)

OTHER PUBLICATIONS

International Search Report and Written Opinion, Application No. PCT/EP2011/064073, 16 pages, Nov. 2, 2011.
(Continued)

*Primary Examiner* — Joseph Dallo
(74) *Attorney, Agent, or Firm* — Slayden Grubert Beard PLLC

(57) ABSTRACT

A method for adapting the injection characteristic of a fuel injection valve of an internal combustion engine to production-related tolerances is described. In the method, an injection quantity correction value is determined from the deviation of the idle travel and the deviation of the injection quantity of the injection valve before the operating phase of the injector. This injection quantity correction value is used to determine the injection-specific deviation of the injection quantity during the operating phase at the start of the operating phase of the injector in conjunction with the current deviation of the idle travel which is determined in the system. The injector-specific deviation of the injection quantity which is determined is used to correct the injection
(Continued)

characteristic. As a result, changes in the injection quantity of an injector can be detected and corrected particularly precisely on the basis of production tolerances.

14 Claims, 3 Drawing Sheets

(51) Int. Cl.
*F02M 61/16* (2006.01)
*F02M 65/00* (2006.01)

(52) U.S. Cl.
CPC ..... *F02M 61/168* (2013.01); *F02M 65/001* (2013.01); *F02M 65/005* (2013.01); *F02D 41/2435* (2013.01); *F02D 41/2441* (2013.01); *F02D 41/2477* (2013.01); *F02D 2200/063* (2013.01); *F02D 2200/0614* (2013.01); *F02M 2200/8007* (2013.01); *F02M 2200/8092* (2013.01)

(58) Field of Classification Search
CPC .. F02D 41/2467; F02D 41/2477; F02D 41/40; F02M 2200/8007; F02M 2200/8092; F02M 61/168; F02M 65/001; F02M 65/005
USPC ..... 123/480; 701/104
See application file for complete search history.

(56) References Cited

U.S. PATENT DOCUMENTS 7,040,297 B2 * 5/2006 Baranowski ..... F02D 41/2096 123/478
7,139,657 B2 11/2006 Bouchain et al. ..... 701/104
7,406,861 B2 8/2008 Jung et al. ..... 73/114.45
7,505,846 B2 * 3/2009 Stoecklein ..... F02D 41/2096 123/490
7,765,054 B2 7/2010 Jung et al. ..... 701/105
8,714,140 B2 * 5/2014 Borchsenius ..... F02D 41/008 123/494
2002/0148441 A1 * 10/2002 Tuken ..... F02D 41/0085 123/436
2006/0082252 A1 * 4/2006 Allmendinger ..... F02D 41/2096 310/316.03
2007/0250248 A1 * 10/2007 Frank ..... F02D 41/2096 701/103
2010/0101544 A1 * 4/2010 Jung ..... F02D 41/0007 123/559.1
2010/0116911 A1 * 5/2010 Fritsch ..... F02D 41/2096 239/580
2010/0305836 A1 * 12/2010 Okada ..... F02D 41/2438 701/106
2011/0077843 A1 3/2011 Hauser ..... 701/105
2011/0120423 A1 * 5/2011 Borchsenius ..... F02D 41/008 123/494
2011/0192372 A1 * 8/2011 Guglielmone ..... F02D 41/401 123/294
2013/0066538 A1 3/2013 Brandt et al. ..... 701/105
2013/0152902 A1 * 6/2013 Brandt ..... F02D 41/2432 123/480

FOREIGN PATENT DOCUMENTS

DE 102006039522 A1 3/2008 ..... F02D 41/20
DE 102009009270 A1 8/2010 ..... F02D 41/20
WO 2012/025428 A1 3/2012 ..... F02D 41/40

OTHER PUBLICATIONS

Chinese Office Action, Application No. 201180041335.2, 11 pages, Jan. 28, 2015.

* cited by examiner

METHOD FOR ADAPTING THE INJECTION CHARACTERISTIC OF AN INJECTION VALVE

CROSS-REFERENCE TO RELATED APPLICATIONS

This application is a U.S. National Stage Application of International Application No. PCT/EP2011/064073 filed Aug. 16, 2011, which designates the United States of America, and claims priority to DE Application No. 10 2010 039 841.1 filed Aug. 26, 2010, the contents of which are hereby incorporated by reference in their entirety.

TECHNICAL FIELD

The present disclosure relates to a method and system for adapting the injection characteristic, representing a setpoint injection behavior, of a fuel injection valve (injector), arranged in an injection system, of an internal combustion engine to production-related tolerances.

BACKGROUND

The quantity-metering accuracy of injectors, in particular servo-controlled piezo injectors, is subject to tolerances in production which make injector-specific correction (classification) of the individual injectors necessary. This classification of the individual injectors is used in the injection system (engine/vehicle) to correct the deviations from one injector to another. Such early classification of an injector with respect to its quantity tolerance, for example during final function testing during production, can, however, not ensure that no quantity-related change in the injection of the injector has taken place up to the first time it is put into service in the system. In other words, after the final function testing, quantity-related changes may still occur which are not taken into account in the preceding classification.

On the other hand, determination of the absolute injection quantities of the injectors during the operation of the system is linked to defined operating states of the system, for example a sufficiently long thrust phase at a constant operating temperature. Such quantity measurement and resulting calculation of the quantity deviation with respect to $Q_{SETP}$ with subsequent correction can therefore under certain circumstances not be carried out precisely and reliably for a long time. This results in that quantity deviations owing to production tolerances may already be present beforehand during operation, with the result that uncorrected injection processes have already occurred.

Such quantity-related changes of the injector which occur early are due, in particular, to an idle-stroke-dependent component of the injector. Such an idle-stroke-dependent component usually exhibits high dynamics. As a result, significant changes in the idle stroke of the injector may be exhibited from the production and functional classification of the injector up to the time when it is first put into service in the system (vehicle/engine), (rapid idle stroke drift).

The term "idle-stroke-dependent" can be explained as follows. The tolerances which are responsible for the quantity variations in injectors can be divided into two groups. The first group is dependent on the idle stroke of the drive (piezo-drive) of the injector, while the second group is formed by a component which is independent of the drive. The tolerance component which is independent of the idle stroke usually has low dynamics (for example seat wear at the needle seat or at the servo valve seat). Corresponding correction strategies in the system therefore have a sufficiently long time to detect and to correct a change in the tolerances which are independent of the idle stroke. In contrast, the idle-stroke-dependent component usually exhibits high dynamics. A correction strategy which is intended to counteract this therefore has to be capable of detecting a change in the idle stroke from the first operation of the injector and to correct it in the system. However, solely determining the current idle stroke of the injector in the system is not sufficient. In order to correct an idle-stroke-based change in quantity of an injector, the current idle stroke should be known during the quantity classification of the injector.

The following summary can therefore be made: solely classifying the injector with respect to its quantity tolerance during final function testing during production is therefore not sufficient since up to the time of putting into service quantity-related changes may have taken place which are due, in particular, to idle-stroke-dependent tolerance components. On the other hand, quantity adjustment which is carried out during the operating phase for correction purposes is dependent on specific operating phases and therefore, under certain circumstances, cannot take place until relatively late, with the result that in the preceding operating phase uncorrected injections have already taken place.

In German patent application 10 2010 021 168.0, which was not published before the priority date of the present document, methods are described for detecting the idle stroke of the actuator of an injector in a hydraulic and/or electrical way. These methods may be carried out continuously and when a change in idle stroke is detected a corresponding correction of the injection time of the injector can be carried out.

DE 102 57 686 A1 discloses a method for adapting the characteristic of an injection valve of an internal combustion engine to age-related changes in an actual injection behavior, wherein rotation speed values of the internal combustion engine for work cycles of the injection valve are detected with and without actuation, a difference between the detected values is formed, and therefore a correction of the injection characteristic is performed.

SUMMARY

One embodiment provides a method for adapting the injection characteristic, representing a setpoint injection behavior, of a motor vehicle injection valve (injector), arranged in an injection system, of an internal combustion engine to production-related tolerances, comprising the following steps: (a) before the operating phase of the injector: determining the ACTUAL idle stroke of the injector; detecting the deviation of the ACTUAL idle stroke from a nominal idle stroke; determining the ACTUAL injection quantity of the injector; detecting the deviation of the ACTUAL injection quantity from a nominal injection quantity; and detecting an injection quantity correction value from the idle stroke deviation and the injection quantity deviation; and (b) at the start of the operating phase of the injector: use of the detected injection quantity correction value and of the current idle stroke deviation, determined in the system, for detecting the injector-specific injection quantity deviation during the operating phase; and use of the detected injector-specific injection quantity deviation for correcting the injection characteristic.

In a further embodiment, the determination of the ACTUAL idle stroke of the injector is carried out in parallel with the quantity classification of the injector.

In a further embodiment, the determination of the ACTUAL idle stroke and the correction of the injection characteristic are carried out continuously and at any time.

In a further embodiment, the detected injection quantity correction value is used to individually characterize the injector with respect to idle-stroke-dependent and idle-stroke-independent quantity tolerance.

In a further embodiment, the individual characterization of the injector is carried out during a function test.

In a further embodiment, an injector code is produced from the individual characterization of the injector.

In a further embodiment, the produced injector code is read into the injection system in order to initialize the injection quantity correction and idle stroke correction.

BRIEF DESCRIPTION OF THE DRAWINGS

Exemplary embodiments will be explained in more detail below based on the schematic drawings, wherein.

DETAILED DESCRIPTION

Figure 1:
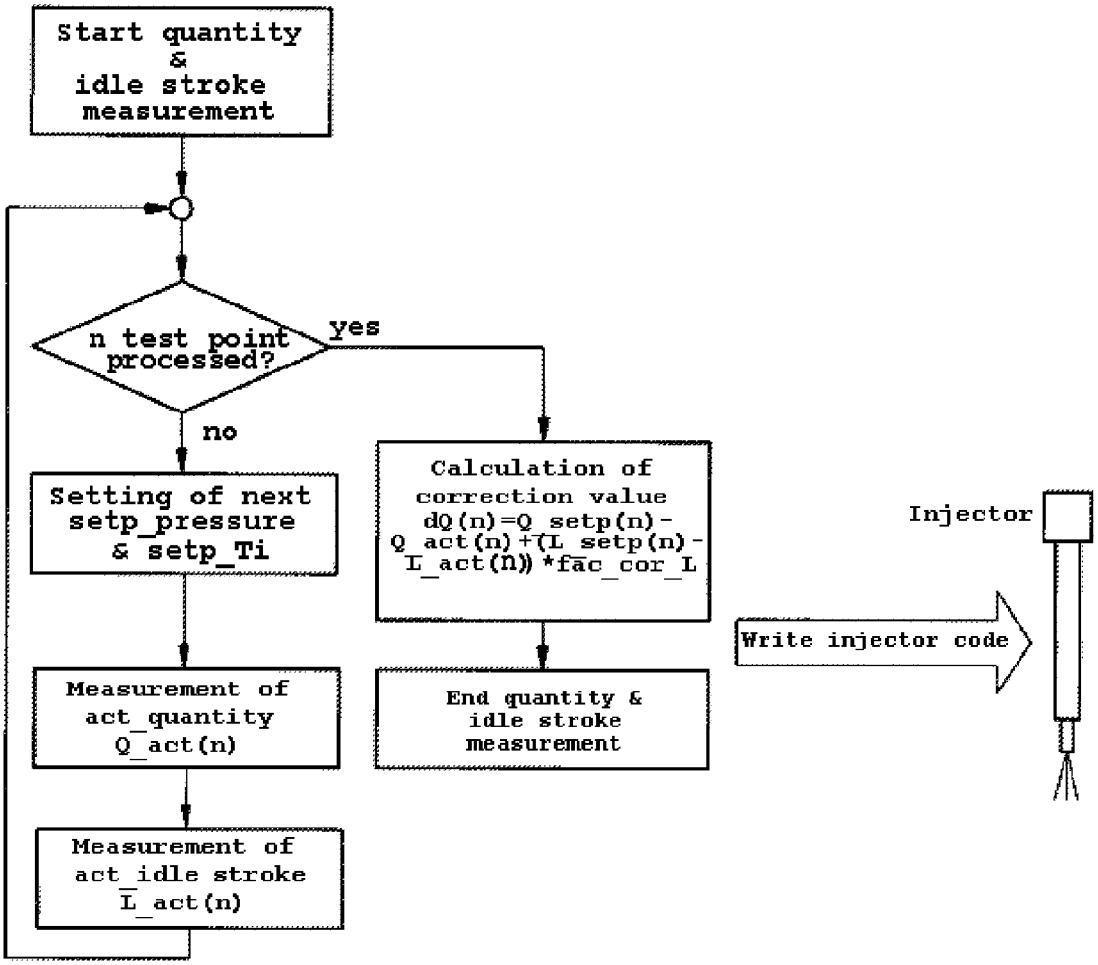
FIG. 1 shows a flowchart of part of the adaptation and correction method during a function test during the production of an injector.

Embodiments of the present disclosure provide a method and system with which injection quantity changes of an injector owing to production tolerances can be particularly precisely detected and corrected from the first time the injector operates.

For example, some embodiments provide a method of the specified type by means of the following steps:

before the operating phase of the injector:

determining the ACTUAL idle stroke of the injector;

detecting the deviation of the ACTUAL idle stroke from a nominal idle stroke;

determining the ACTUAL injection quantity of the injector;

detecting the deviation of the ACTUAL injection quantity from a nominal injection quantity;

detecting an injection quantity correction value from the idle stroke deviation and the injection quantity deviation;

at the start of the operating phase of the injector:

use of the detected injection quantity correction value and of the current idle stroke deviation, determined in the system, for detecting the injector-specific injection quantity deviation during the operating phase;

use of the detected injector-specific injection quantity deviation for correcting the injection characteristic.

According to certain embodiments it is therefore proposed to determine the injector-specific idle stroke before the operating phase of the injector, i.e. in particular during the quantity classification of the individual injectors during production, in addition to the injection quantity determination. The idle stroke determination can be carried out here in parallel with the injection quantity determination (quantity classification) of the individual injectors without lengthening the production cycle times. An injection quantity correction value is then determined from the detected injection quantity deviation with respect to corresponding nominal values, and idle stroke deviation. In this way, the idle-stroke-dependent portion of the quantity deviation is therefore taken into account in the injector-specific quantity correction.

The determination of the ACTUAL injection quantity and of the ACTUAL idle stroke of the corresponding injector can occur here in a known fashion, as is stated, for example, in the art mentioned above.

At the start of the operating phase of the injector, the detected injection quantity correction value can then be used, together with the current idle stroke deviation determined in the system, to detect the injector-specific injection quantity deviation during the operating phase. The detected injector-specific injection quantity deviation is used to correct the injection characteristic. By means of the correction which is carried out in this way, it is therefore possible to correct an idle-stroke-related change in quantity of the individual injectors from the first operating time on. Changes in the idle stroke from the time of characterization of the injector (final function testing) up to the first operating use in the system can therefore be corrected. A corresponding change in quantity can be compensated.

If the injector-specific variables of the quantity deviation from a nominal quantity relating to the respective test point $$\Delta Q_{inj_i}(Ti,P)=Q_{NOM}(Ti,P)-Q_{inj_i}(Ti,P)$$

where Ti=period of electrical actuation, P—rail pressure and the injector-specific variables of the idle stroke deviation from a normal idle stroke $$\Delta LH_{inj_i}(P)=LH_{NOM}(P)-LH_{inj_i}(P)$$

where P=rail pressure have been detected and are therefore known, the idle-stroke-dependent portion of the quantity deviation is taken into account in the injector-specific quantity correction as follows:

$$\Delta Q_{inj_i_kor}(Ti,P)=Q_{NOM}(Ti,P)-Q_{inj_i}(Ti,P)+[LH_{NOM}(P)-LH_{inj_i}(P)]\cdot Fac_cor_lh$$

In this context, Fac_cor_lh represents the relationship between a change in quantity owing to a change in idle stroke at the defined operating point (Ti,P).

In the system (at the start or during the operating phase), an injector-specific quantity correction is then carried out as follows:

$$\Delta Q_{inj_i}Ti,P)=\Delta Q_{inj_i_kor}(Ti,P)-[LH_{NOM}(P)-LH_{akt}(P)]\cdot Fac_cor_lh$$

Here, $LH_{akt}(P)$ is the injector-specific idle stroke which is determined in the system at a particular time.

As already mentioned, the determination of the ACTUAL idle stroke of the injector, and therefore the detection of the deviation of the ACTUAL idle stroke from a nominal idle stroke, is carried out in parallel with the quantity classification of the respective injector.

Of course, the determination of the ACTUAL idle stroke and the resulting correction of the injection characteristic can be carried out continuously and at any time.

The detected injection quantity correction value is expediently used to individually characterize the injector with respect to idle-stroke-dependent and idle-stroke-independent quantity tolerance. This individual characterization of the injector may be carried out during a function test (final function test) of the injector.

An injector code is specifically produced from the individual characterization of the injector, to be precise before the operating phase of the injector, for example after a function test has been carried out during the production. This produced injector code is then read into the injection system (into the corresponding control unit), in order to initialize the injection quantity correction and idle stroke correction. After this, the desired quantity correction can then be carried out in the injection system.

Overall, the correction for the production-related, injector-specific quantity tolerance may therefore be apportioned into a portion which is dependent on the idle stroke and a portion which is independent of the idle stroke. As a result, the idle-stroke-dependent portion which is subject to high dynamics (for example changing of the idle stroke due to temperature, polarization state of the actuator, load, etc.) can be taken into account specifically when carrying out the correction. As a result of the apportioning of the tolerances into a part which is dependent on the idle stroke and a part which is independent of the idle stroke, the idle-stroke-related quantity tolerances can be corrected from the start of the operating phase of the injection system onward, i.e. from 0 km on. The determination of the current idle stroke in the system (in the operating phase) can take place in parallel with the general operating states of the injector in the system, i.e. the determination of the idle stroke and correction can take place continuously and at any time. Accordingly, the determination of the current total quantity tolerance of an injector in the system requires defined operating states of the system (for example a sufficiently long thrust phase), and cannot generally take place at any time, in particular not when the motor is first operated.

As a result of the disclosed method, storage-optimized management of the injector-specific correction values can take place. The described adaptation and correction method enables, in particular, correction of idle-stroke-related quantity tolerance from the production of the injector to a time when the injector is first put into service in the system, and therefore permits a closed correction chain.

The disclosed method may be performed in a control system of the internal combustion engine, which includes software or other computer instructions stored in a memory device or other tangible computer storage medium and executable by a processor to perform any of the disclosed method steps.

FIG. 1 shows a flowchart of the method in a function test during the production of an injector. The first step starts with the measurement of the quantity and idle stroke. In this context, n test points are to be processed. A predefined setpoint pressure and a predefined setpoint injection time are set for each test point. In the next steps, the respective ACTUAL quantity and the respective ACTUAL idle stroke are then measured for each test point. If n test points are processed in this way, an injection quantity correction value dQ(n) is detected. For this purpose, the measured ACTUAL quantity is subtracted from the predefined SETPOINT quantity. In addition, the measured ACTUAL idle stroke is subtracted from the predefined SETPOINT idle stroke. The idle stroke deviation which is obtained here is multiplied by the factor fac_cor_L. This factor represents the relationship between a quantity change and an idle stroke change at the corresponding operating point, and is detected empirically. By adding the two portions (quantity deviation and idle stroke deviation), the corresponding correction value is obtained and is assigned in the form of an injector code to the respective injector.

Figure 2:
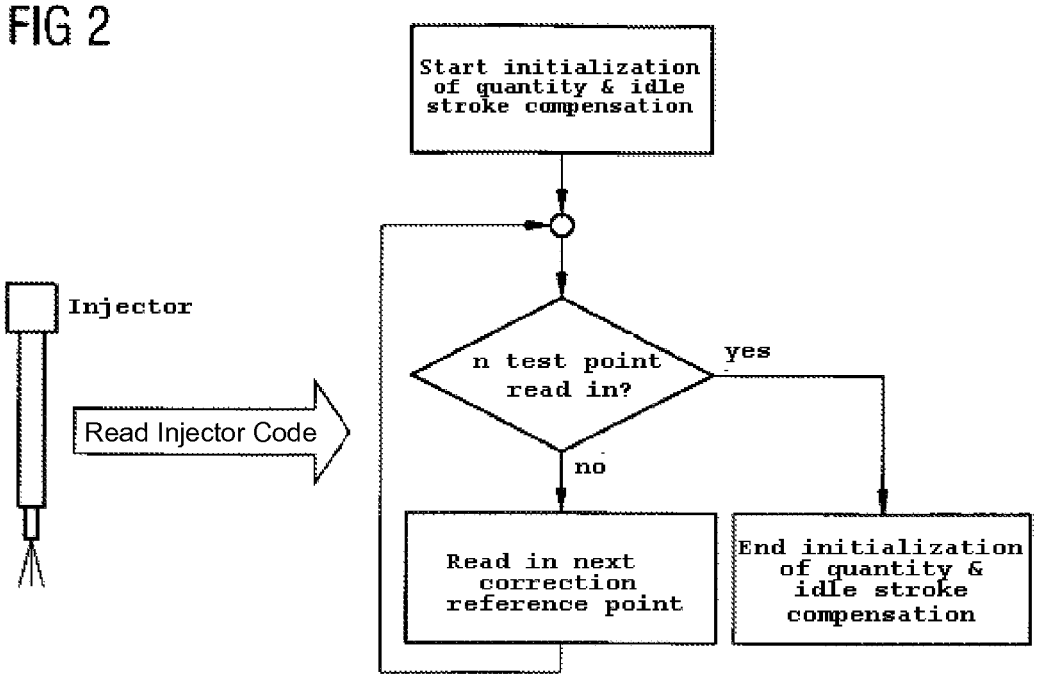
FIG. 2 shows a flowchart relating to the initialization of the method in an injection system.

FIG. 2 shows a flowchart relating to the initialization of the quantity compensation and idle stroke compensation. The injector code which is detected according to FIG. 1 and written in is read in for n test points.

Figure 3:
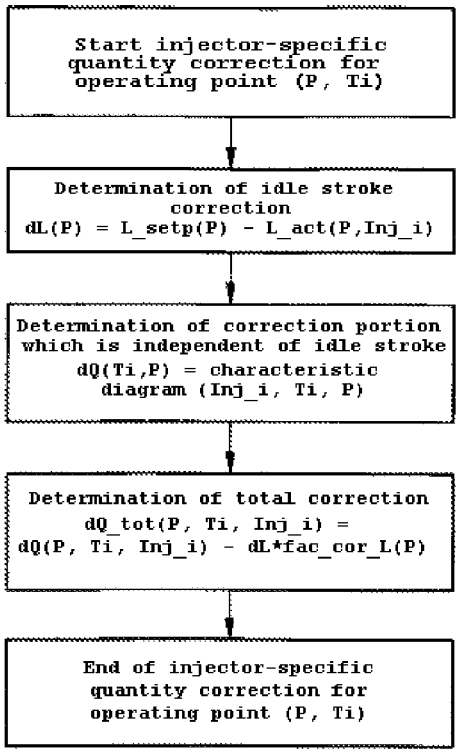
FIG. 3 shows a flowchart of part of the method for carrying out a quantity correction in the injection system during the operating phase.

FIG. 3 shows a flowchart for the injector-specific quantity conjuncture, carried out in the operating phase for an operating point (P,Ti), for a respective operating point. In this context, the idle stroke correction dL(P) is detected by subtracting the current ACTUAL idle stroke L_act(P, Inj_i) from the predefined setpoint idle stroke L_setp(P), the idle-stroke-independent correction portion dQ(Ti,P)=characteristic diagram (Inj_i, Ti, P) and the total correction dQ_tot (P, Ti, Inj_i)=dQ(P, Ti, Inj_i)−dL*fac_cor_L(P).

What is claimed is:

1. A method for amending an injector code of an injector to control a injection characteristic, the injection characteristic representing a setpoint injection behavior of injector arranged in an injection system of an internal combustion engine, the method comprising:

before entering an operating phase of the injector during normal operation of the internal combustion engine, conducting a quantity classification of the injector, the quantity classification including:

determining an ACTUAL idle stroke of the injector;

calculating a deviation of the ACTUAL idle stroke from a nominal idle stroke;

determining an ACTUAL injection quantity of the injector;

calculating a deviation of the ACTUAL injection quantity from a nominal injection quantity; and calculating an injection quantity correction value by calculating a sum of (a) an idle stroke deviation correction component corresponding to the calculated idle stroke deviation and (b) an injection quantity deviation correction component corresponding to the calculated injection quantity deviation;

then, during the operating phase of the injector and normal operation of the internal combustion engine, using the calculated injection quantity correction value and a measured idle stroke deviation determined during the operating phase to calculate an injector-specific injection quantity deviation for the normal operation of the internal combustion engine; and using the calculated injector-specific injection quantity deviation to amend the injector code of the injector and thereby correct the injection characteristic.

2. The method of claim 1, comprising performing the determination of the ACTUAL idle stroke of the injector and the determination of the ACTUAL injection quantity of the injector in parallel.

3. The method of claim 1, comprising performing the determination of the ACTUAL idle stroke and the correction of the injection characteristic continuously.

4. The method of claim 1, comprising using the determined injection quantity correction value to individually characterize the injector with respect to idle-stroke-dependent and idle-stroke-independent quantity tolerance.

5. The method of claim 4, comprising performing the individual characterization of the injector during a function test.

6. The method of claim 1, comprising reading the produced injector code into the injection system to initialize the injection quantity correction and idle stroke correction.

7. A control system for amending an injector code of an injector to control an injection characteristic of an injector of an injection system of an internal combustion engine, the control system including computer instructions stored in non-transitory computer readable media and executable by a processor to:

Before entering an operating phase of the injector during normal operation of the internal combustion engine, conducting a quantity classification of the injector, the quantity classification including:

determining an ACTUAL idle stroke of the injector;

calculating a deviation of the ACTUAL idle stroke from a nominal idle stroke;

determining an ACTUAL injection quantity of the injector;

calculating a deviation of the ACTUAL injection quantity from a nominal injection quantity; and calculating an injection quantity correction value by calculating a sum of (a) an idle stroke deviation correction component corresponding to the calculated idle stroke deviation and (b) an injection quantity deviation correction component corresponding to the calculated injection quantity deviation;

then, during the operating phase of the injector and normal operation of the internal combustion engine, use the calculated injection quantity correction value and a measured idle stroke deviation determined during the operating phase to calculate an injector-specific injection quantity deviation for the normal operation of the internal combustion engine; and use the calculated injector-specific injection quantity deviation to amend the injector code of the injector and thereby correct the injection characteristic.

8. The control system of claim 7, configured to perform the determination of the ACTUAL idle stroke of the injector and the determination of the ACTUAL injection quantity of the injector in parallel.

9. The control system of claim 7, configured to perform the determination of the ACTUAL idle stroke and the correction of the injection characteristic continuously.

10. The control system of claim 7, configured to use the determined injection quantity correction value to individually characterize the injector with respect to idle-stroke-dependent and idle-stroke-independent quantity tolerance.

11. The control system of claim 10, configured to perform the individual characterization of the injector during a function test.

12. The control system of claim 7, configured to read the produced injector code into the injection system to initialize the injection quantity correction and idle stroke correction.

13. The method of claim 1, wherein the idle stroke deviation correction component comprises the determined idle stroke deviation multiplied by an empirically determined correction factor.

14. The control system of claim 7, wherein the idle stroke deviation correction component comprises the determined idle stroke deviation multiplied by an empirically determined correction factor.

* * * * *